United States Patent [19]

Kawamoto et al.

[11] Patent Number: 4,530,596

[45] Date of Patent: Jul. 23, 1985

[54] ELECTROSTATIC COPYING APPARATUS

[75] Inventors: Kiyoaki Kawamoto; Kastuhiro Shukuri; Takayoshi Hashimoto; Yoshio Yamazaki; Shigeru Inowa, all of Hachioji, Japan

[73] Assignee: Konishiroku Photo Industry Co., Ltd., Tokyo, Japan

[21] Appl. No.: 465,325

[22] Filed: Feb. 9, 1983

[30] Foreign Application Priority Data

Feb. 17, 1982 [JP] Japan ..... 57-25047

[51] Int. Cl.[3] ..... G03G 21/00

[52] U.S. Cl. ..... 355/15; 15/256.52; 118/652

[58] Field of Search ..... 355/15; 15/1.5, 256.5, 15/256.51, 256.52; 118/652

[56] References Cited

U.S. PATENT DOCUMENTS

| | | | |
|---|---|---|---|
| 3,807,853 | 4/1974 | Hudson | 355/15 |
| 3,848,994 | 11/1974 | Fraser | 15/1.5 R |
| 4,101,215 | 7/1978 | Fottner et al. | 15/1.5 R |

*Primary Examiner*—Richard L. Moses

*Attorney, Agent, or Firm*—Jordan B. Bierman

[57] ABSTRACT

A cleaning system for an electrostatic copying apparatus has a cleaning roller in pressure contact with a toner supporting member for removing residual toner therefrom. The cleaning roller is impressed with a bias voltage of polarity opposite to the electric charge held by the residual toner. The cleaning roller comprises an axle, a conductive elastic layer around the axle, and a thin porous film formed as an outer most layer over the elastic layer. The thin film is preferably made of polytetrafluorethylene and is a porous and soft film. The cleaning system also includes a discharging electrode arranged before the cleaning roller, and a scraper for removing toner adhering to the cleaning roller.

21 Claims, 5 Drawing Figures

ELECTROSTATIC COPYING APPARATUS

FIELD OF THE INVENTION

The present invention relates to an improved cleaning system used in an electrostatic copying apparatus.

DESCRIPTION OF THE PRIOR ART

Generally, in an electrostatic copying apparatus, a latent image is formed in such a manner that a corona charge is applied onto a photoconductive layer on a drum or a belt and thereafter an image wise exposure is performed, or a latent image is formed on a dielectric layer coated on the drum or belt through an ion modulating or other method. The latent image on the image supporting member comprising the photoconductive layer or the dielectric layer receives a layer of toner, by which the latent image becomes a toner image in the ordinary electrophotographic development process. The toner image formed on the image supporting member is transferred onto a transfer sheet such as a copy paper, and any toner still remaining on the image supporting member is then cleaned off to make the image supporting member ready for the next image formation. As a method for cleaning the toner remaining on the image supporting member, there is known a roller-type cleaning method. This invention relates to an improvement of the roller-type cleaning system.

In a method for cleaning residual toner from the image supporting member by bringing a cleaning roller into contact with the image supporting member and by scraping toner or causing toner to adhere to the roller, it is necessary to remove sufficiently the toner adhering to the cleaning roller, as well as to remove residual toner on the image supporting member.

For example, when the surface of the cleaning roller is a neoprene rubber having a mat surface, it is not easy to remove toner adhering to the surface of the cleaning roller though the residual toner on the image supporting member may satisfactorily be removed. As a means for removing toner adhering to the cleaning roller, there have been known removing means such as a fur brush, a bias roller made of metal, a scraping blade or the like. The fur brush and the bias roller made of metal are inferior in their toner removing capability. The scraping blade, on the other hand, is difficult to be incorporated in actual apparatus because the friction resistance between the scraping blade and the surface of the cleaning roller is high, and the pressure force of the blade against the cleaning roller and the driving torque for rotation of the cleaning roller must be made excessively high.

For a solution of the aforesaid problems, there is available a measure in which the surface of the cleaning roller is smooth. For example, Japanese Patent Publication Open to Public Inspection Nos. 127,240/1977 and 19,752/1976 propose to arrange a covering layer of synthetic resin on the surface of the cleaning roller, for example, a polyethylene, polyamide, or other material as the covering layer. Owing to the smooth covering layer thus arranged, it is easy to bring a scraping blade for removing the toner from the cleaning roller into contact with said cleaning roller, and the load to drive said cleaning roller is reduced. However, the cleaning roller having the covering layer of aforesaid material has less capacity for cleaning the residual toner on the image supporting member, because of the increase in hardness of said cleaning roller, and consequently the decrease of physical attracting power to embrace and to adhere toner from the surface of the image supporting member, and thereby the ability thereof to clean the surface of said image supporting member falls.

SUMMARY OF THE INVENTION

An object of the present invention is to provide, in an electrostatic copying apparatus, a cleaning system comprising a cleaning roller wherein toner adhering to the surface of the cleaning roller and the hardness of the surface of said cleaning roller does not increase, and thereby the cleaning ability thereof for a toner supporting member does not fall.

Above object is attained by an electrostatic copying apparatus having a cleaning system comprising a cleaning roller in contact with a toner supporting member and rotating in the same direction as said toner supporting member, for removing residual toner from said toner supporting member, means impressing a bias voltage whose polarity is opposite to the electric charge of the residual toner, said cleaning roller comprising an axle and a conductive elastic layer formed around said axle and a porous outermost layer.

DETAILED DESCRIPTION OF THE PREFERRED EMBODIMENTS

Figure 1:
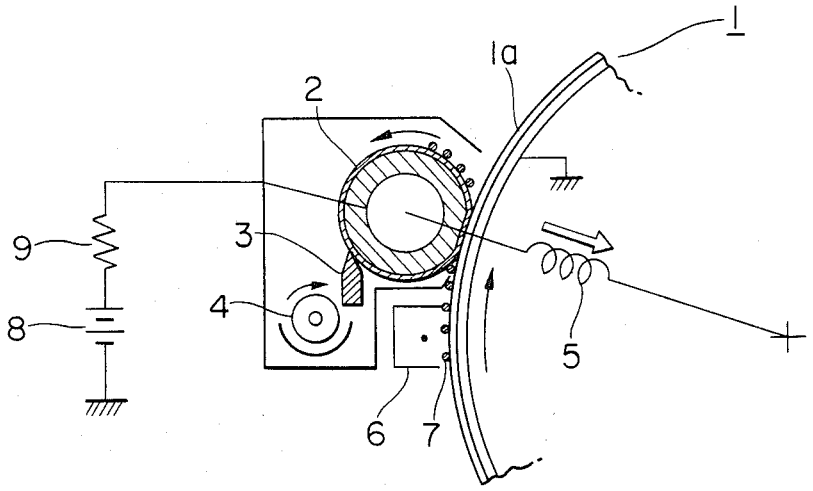
FIG. 1 is a schematic view of a cleaning system for an electrophotographic photoreceptor drum according to one example of the present invention.

FIG. 1 shows a schematic view of a cleaning system for an electrophotographic apparatus showing a first example of the present invention. Against the surface of photoreceptor drum 1 rotating clockwise as an image supporting member, a cleaning roller 2 is pressed in the direction toward the center of said drum 1 (shown with a white arrow) by spring member 5 arranged at both ends of said cleaning roller. In the present example, the cleaning roller 2 is arranged so that it rotates as being driven by said drum 1. On the cleaning roller 2, a bias voltage whose polarity is opposite to that of residual toner 7 adhering to said drum 1 is impressed by a power source 8 through a resistance 9. Thereby the residual toner 7 is attracted to said cleaning roller 2 through the physical and electrical adhesive power, and thus the surface of the drum 1 is cleaned. Residual toner 7 adhering to the cleaning roller 2 is scraped off by a scraping blade 3 and drops onto a spiral roller 4 used as a means of conveyance. Residual toner 7 dropped on the spiral roller 4 is conveyed by the rotation thereof to one end and recovered. Regarding the composition of the cleaning roller 2, an axle thereof is covered by a conductive rubber material whose conductivity is preferably in the range of $10^{-6}$–$10^{-10}$ν/cm and whose rubber hardness is about 35°–65°. The conductive rubber layer thereof is covered by a porous material. The cleaning roller 2 is arranged to press the surface of the image supporting member with a pressure force of 200–700 g (per cm in the direction of the roller axle). The outside diameter of the cleaning roller 2 used in the present example is 30 mmϕ, and the thickness of the conductive rubber layer is 5 mm. The cleaning roller with an outside diameter in the range of about 20 mmϕ–30 mmϕ is preferably used. A bias voltage whose polarity is opposite to that of the electric charge of the residual toner 7 on a photoconductive layer 1*a* is impressed thereon by the power source 8 through the resistance 9. The surface potential on the cleaning roller 2 used in the present example is established at about 1.0–1.6 KV. The residual toner 7 on the photoconducting layer 1*a* has an electric charge with a certain polarity before it enters the cleaning process. For example, in the process of electrophotography wherein Se is used as a photoconductor, the polarity of electric charge of toner is negative because of the development of a latent image whose polarity is positive. Therefore the cleaning roller 2 is impressed with a D.C. bias voltage of positive polarity, and as a result the residual toner 7 is attracted electrostatically to said cleaning roller 2. Further, since the cleaning roller 2 is pressured in contact with the surface of the photoreceptor drum 1 by an appropriate toner, particles 7 bore into the porous surface on the cleaning roller 2, which enhances the cleaning function together with adsorption forces, such as Van der Waals force, and the electrostatic force.

Residual toner 7, when entering the cleaning process, has a negative electric charge as mentioned above. On the photosensitive layer 1*a*, there are positive electric charges at positions corresponding to the residual toner 7 on the photosensitive layer 1*a*, so that they attract each other. Now, if a discharging electrode 6 impresses a high A.C. voltage of about 4–6 KV, so as to discharge the surface of said photosensitive layer 1*a*, the electric charges of said photosensitive layer 1*a* and said toner 7 are eliminated. Accordingly, the attracting force that acts on both said photosensitive layer and said toner is reduced, and thereby the cleaning efficiency is further increased. Further, it is possible to take measures to improve the cleaning efficiency wherein said discharging electrode 6 is impressed with a negative D.C. high voltage and discharges onto the surface of said photosensitive layer 1*a* a negative corona discharge, whereby the residual toner is charged negatively. Accordingly, the electrostatic adsorption force between residual toner charged negatively and said cleaning roller 2 on which the positive bias voltage is impressed is increased, and thereby the cleaning efficiency is increased.

Figure 2:
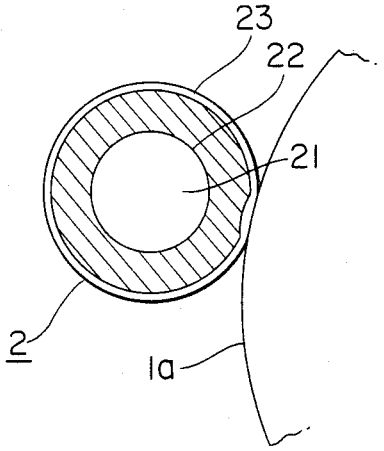
FIG. 2 is a cross-sectional view of a cleaning roller exemplified in FIG. 1.

FIG. 2 is an enlarged sectional view of the cleaning roller 2 showing in FIG. 1 wherein a conductive elastic rubber layer 22 is arranged around a conductive metallic axle 21, and an outermost layer 23 is made of a soft, flexible and porous surface film.

Figure 3:
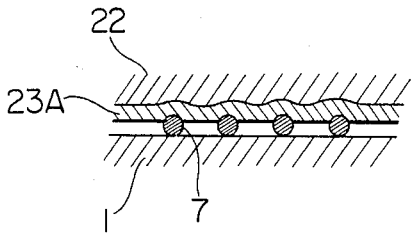
FIG. 3 and FIG. 4 are enlarged views of the pressure-contact section between a photoreceptor and the cleaning roller.
Figure 4:
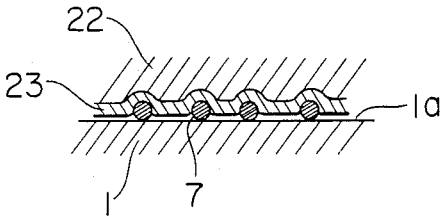

FIG. 3 and FIG. 4 represent enlarged sectional views showing a specific characteristic of the surface film of the cleaning roller 2 and its effect on removing toner particles 7 on the photoreceptor 1. As shown in FIG. 3, when the surface film of the cleaning roller 2 is hard, like the film 23A, the residual toner 7 on the photoreceptor drum 1 embed only partially into the hard surface film 23A. Consequently, the physical adhering force acting between the hard surface film 23A of the cleaning roller 2 and toner particle 7 is weak, and only the electrostatic adhering force between them exists, which reduces the cleaning efficiency thereof.

When the hardness of the porous film is low and the cleaning roller 2 is in pressure contact with photoreceptor 1 which carries the residual toner 7 on the surface thereof, the toner particles 7 embed temporarily into the porous film 23 considerably as shown in FIG. 4. Generally, the physical adhering force acting between the cleaning roller and the toner particles is lowered when a resin film is arranged on said cleaning roller. When a porous film is arranged on the cleaning roller, the adhering force between the toner particles and the cleaning roller is nearly the same as that between toner particles and an elastic rubber roller on which no film 23 is arranged.

As a porous material to be used as the outermost layer of the cleaning roller 2 in the present invention, polytetrafluoro ethylene porous material (made by Sumitomo Denko Co. and known as "Poreflon") is preferable. Cavity diameter available for Poreflon is up to about 10μ and a porosity thereof is up to about 85%. Consequently, its surface area is extremely large, and a cleaning roller having a soft surface may be obtained. Thus it is possible to obtain a film which is extremely advantageous from the viewpoint of cleaning characteristics for electrophotography. In the example, the cleaning roller was covered by a Poreflon film with a thickness of about 10–50μ.

Figure 5:
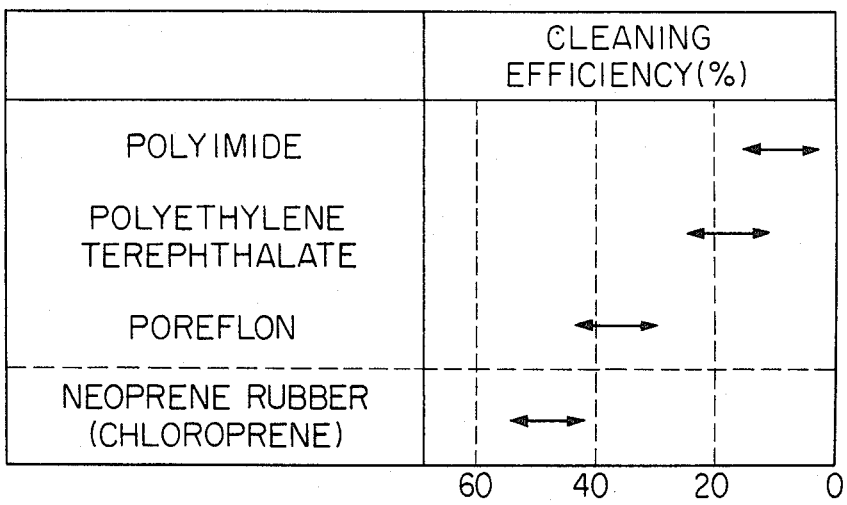
FIG. 5 indicates film materials for the cleaning roller and their cleaning efficiencies.

As a film material for the surface of the cleaning roller 2, aforesaid Poreflon has an excellent physical adhering force. FIG. 5 shows cleaning efficiencies of various film materials under the same conditions but with varying thickness and porosity of the outmost layer. As is clear from the figure, the adhering force of the cleaning roller 2 covered by a polyimide film or by polyethylene terephthalate film (polyester film) is low.

The object of the present invention thus cannot be obtained by an outmost layer of polyimide film or polyester film which is smooth. The thickness of the outmost layer of polyimide film is about 200μ, and for the polyester film about 200μ and 400μ.

The cleaning roller 2 covered by a porous Poreflon film has an excellent adhering force compared with aforesaid two types of films, but is slightly less compared with a cleaning roller covered by a neoprene elastic rubber. Taking into consideration that toner particles adhering to the neoprene rubber surface of the cleaning roller are hard to remove because they get clogged in the cavities of said neoprene rubber, a cleaning roller covered by a Poreflon film is both durable and excellent for the easy removal of toner adhering thereto. However, since Poreflon is insulating in nature, electric charges can accumulate on the surface thereof when the cleaning operation is repeated and the bias voltage is impressed on the cleaning roller. Thus there is a danger that the force to electrically attract residual toner will be reduced, and the cleaning efficiency thereof may fall. Therefore, it is desirable that the electric charge on the cleaning roller be discharged to ground through the scraper 3 made of a conductive member (shown in FIG. 1).

The surface of the cleaning roller covered by a porous Poreflon film is soft, and the surface of the photosensitive layer would not be damaged even if it is rubbed by said cleaning roller. Further, the cleaning roller covered by a Poreflon film has a high capacity to embrace toner particles, and it easily removes toner even when it is driven by the photoreceptor drum without increasing the peripheral speed of the cleaning roller. Although the cleaning roller in the present example shows an excellent cleaning effect when it is driven by an image supporting member, it may naturally be driven independently of the image supporting member so as to move in the same direction synchronizing with the movement of the image supporting member.

Further, the surface energy of the Poreflon film is small and therefore the Poreflon film does not combine chemically with the particles. Thus, toner recovery from the surface of the cleaning roller is easily made by a blade or other means.

In the present invention, the electrostatic cleaning effect is added to the physical and absorbing cleaning effect, and therefore excellent cleaning is obtained. However, it is to be understood that the present invention is not limited to the independent use thereof as a cleaning system. As shown in the example of FIG. 1, for example, it is possible to arrange a discharging electrode 6 for eliminating charges with AC or a voltage wherein AC and DC are superposed before cleaning, to enhance the cleaning effect. It is also possible, by using the present invention together with other known cleaning means, such as a blade, for example, to make a further improved cleaning means or to use it to share the load in cleaning.

What is claimed is:

1. In an electrostatic copying apparatus, a cleaning system comprising a cleaning roller being in contact with a moving toner supporting member and rotating in the direction of movement of said toner supporting member, for removing residual toner held by electric charge on said toner supporting member, the improvement comprising means for impressing on said cleaning roller a bias voltage whose polarity is opposite to that of an electric charge held by said residual toner and said cleaning roller comprising an axle, a conductive elastic layer formed around said axle, and a thin porous film formed as an outermost layer over said elastic layer.

2. A cleaning system according to claim 1, wherein said conductive elastic layer consists essentially of a conductive rubber material, and a conductivity of said layer is 35°–65°.

3. A cleaning system according to claim 1, wherein a diameter of said cleaning roller is 20–40 mmϕ.

4. A cleaning system according to claim 1, wherein said thin film consists essentially of a polytetrafluoroethylene.

5. A cleaning system according to claim 4, wherein a porosity of said thin film is up to 85%.

6. A cleaning system according to claim 1, wherein a thickness of said thin film is 10–50μ.

7. A cleaning system according to claim 4, wherein a thickness of said thin film is 10–50μ.

8. A cleaning system according to claim 1, wherein said toner supporting member is an image supporting member.

9. A cleaning system according to claim 8, wherein said image supporting member is a photoreceptor.

10. A cleaning system according to claim 1, wherein said system further comprises a discharging electrode arranged before said cleaning roller.

11. A cleaning system according to claim 10, wherein said conductive elastic layer consists essentially of a conductive rubber material, and a conductivity of said layer is $10^{-6}$–$10^{-10}$ν/cm and a rubber hardness of said layer is 35°–65°.

12. A cleaning system according to claim 10, wherein said thin film consists essentially of a polytetrafluoroethylene.

13. A cleaning system according to claim 12, wherein a porosity of said thin film is up to 85%.

14. A cleaning system according to claim 10, wherein a thickness of said thin film is 10–50μ.

15. A cleaning system according to claim 12, wherein a thickness of said thin film is 10–50μ.

16. A cleaning system according to claim 10, wherein said toner supporting member is an image supporting member.

17. A cleaning system according to claim 16, wherein said image supporting member is a photoreceptor.

18. A cleaning system according to claim 1, wherein said cleaning roller is in pressure contact with said toner supporting member.

19. A cleaning system according to claim 1, wherein said thin porous film consists essentially of a resin containing fluorine.

20. A cleaning system according to claim 1, wherein said cleaning roller is driven in rotation by said toner supporting member.

21. A cleaning system according to claim 1, further comprising a scraper for removing toner particles adhering to said cleaning roller, wherein said scraper is grounded.

* * * * *